United States Patent [19]

Ogawa

[11] 4,454,679

[45] Jun. 19, 1984

[54] TOY FIGURE CONVERTIBLE INTO TOY VEHICLE

[75] Inventor: Iwakichi Ogawa, Kashiwa, Japan

[73] Assignee: Takara Co., Ltd., Tokyo, Japan

[21] Appl. No.: 380,298

[22] Filed: May 20, 1982

[51] Int. Cl.[3] ..... A63H 11/10

[52] U.S. Cl. ..... 446/290; 446/289

[58] Field of Search ..... 46/103, 104, 105, 106, 46/107, 97, 101, 201, 202, 206, 209, 115, 116, 124, 123

[56] References Cited

U.S. PATENT DOCUMENTS

| | | | |
|---|---|---|---|
| 596,109 | 12/1897 | Gedney | 46/98 |
| 2,272,643 | 2/1942 | Peters et al. | 46/201 |
| 2,567,462 | 9/1951 | Ashworth et al. | 46/103 |

*Primary Examiner*—Mickey Yu

*Attorney, Agent, or Firm*—Jackson, Jones & Price

[57] ABSTRACT

A toy having two portions mountable to one another in two relative configurations, is disclosed. In a first configuration the toy effectively simulates a person, toy character, figure, animal or the like in a substantially upright standing configuration. The toy has a pair of wheels mounted to a lower portion thereof. In a second configuration which is attained by pivoting the two portions relative to one another about an axis substantially normal to the general longitudinal axis of the toy, an additional wheel is exposed for contact with a support surface, and the toy simulates a toy vehicle capable of locomotion on the support surface. In the second configuration the toy also simulates a person, toy figure, character or the like disposed in a prone configuration on the support surface.

18 Claims, 4 Drawing Figures

TOY FIGURE CONVERTIBLE INTO TOY VEHICLE

BACKGROUND OF THE INVENTION

1. Field of the Invention

The present invention is directed to a toy, and more particularly to a toy which is configured to simulate a toy figure or a toy vehicle at the option of a player.

2. Brief Description of the Prior Art

Toy figures and toy vehicles are well known in the prior art. Some toys of the prior art have constituent parts which may be assembled in several configurations to provide a toy figure or a toy vehicle, depending on the specific mode of assembly of the parts. Examples of such reconfigurable toys may be found in U.S. Pat. Nos. 4,051,623; 4,170,840; 4,095,367 and 4,206,564. The reconfigurable toys described in the above-noted patents, however, require disassembly and reassembly of the part in order to convert the toy from a person or figure-simulating configuration into a vehicle-simulating configuration. Therefore, as it will be appreciated by those familiar with the toy industry, the toys of the above-noted patents as well as other reconfigurable toys of the prior art, often are too complicated for very young children. Very young children derive more enjoyment from toys which are converted from one configuration to another without requiring undue effort or concentration by the child. The present invention is designed to provide such a toy.

SUMMARY OF THE INVENTION

It is an object of the present invention to provide a toy which effectively simulates a substantially upright-standing person, toy figure, animal or the like.

It is another object of the present invention to provide a toy which effectively simulates a person, toy figure, animal and the like and is also capable of locomotion upon a support surface.

It is still another object of the present invention to provide a toy which simulates a substantially upright-standing toy figure, person, animal and the like, and which is readily reconfigurable to simulate a toy vehicle and is capable of locomotion on a support surface.

These and other objects and advantages are attained by a toy having a first portion configured to simulate the lower body, including a pair of legs, of a substantially upright-standing person, toy figure, animal and the like. A second portion of the toy is configured to simulate the upper body, including the head, of a person, toy figure, animal and the like. Wheels are incorporated in the first portion and in the second portion.

The second portion is pivotably attached to the first portion about an axis which is substantially normal to the general longitudinal axis of the toy in such a manner that the second portion is capable of occupying two principal positions relative to the first portion. In a first position, the wheels of the second portion are substantially hidden from view and the toy simulates a substantially upright-standing person, toy figure, animal or the like. In a second position of the second portion relative to the first portion, the wheels of the second portion are exposed to cooperate with the wheels of the first portion to provide locomotion for the toy on a support surface. In the second position the toy simulates a toy vehicle, and also a person, toy figure, animal or the like disposed in a substantially prone position upon the support surface.

The features of the present invention can be best understood together with further objects and advantages by reference to the following description, taken in connection with the accompanying drawings, wherein like numerals indicate like parts.

DESCRIPTION OF THE PREFERRED EMBODIMENT

Figure 1:
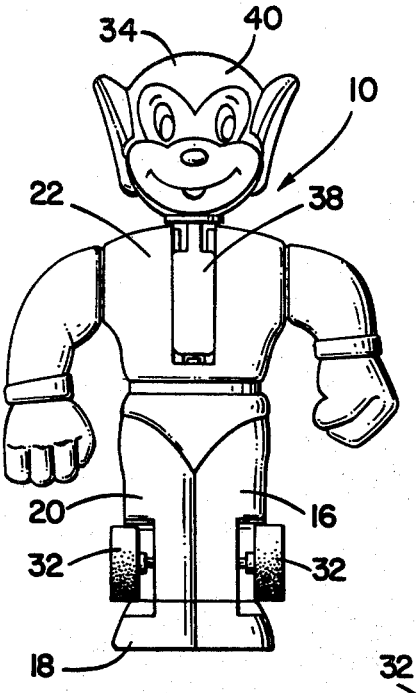
FIG. 1 is a front view of a preferred embodiment of the toy of the present invention.

The following specification, taken in conjunction with the drawings, sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Referring now to the drawing Figures, the preferred embodiment of the toy 10 of the present invention is disclosed. The toy 10 is generally configured to simulate a person, a toy figure or character, or a toy animal in a substantially upright or standing configuration. The toy 10 of the present invention is best manufactured from molded plastic material, although the scope of the invention is not limited by the materials used for manufacturing the toy 10.

Figure 2:
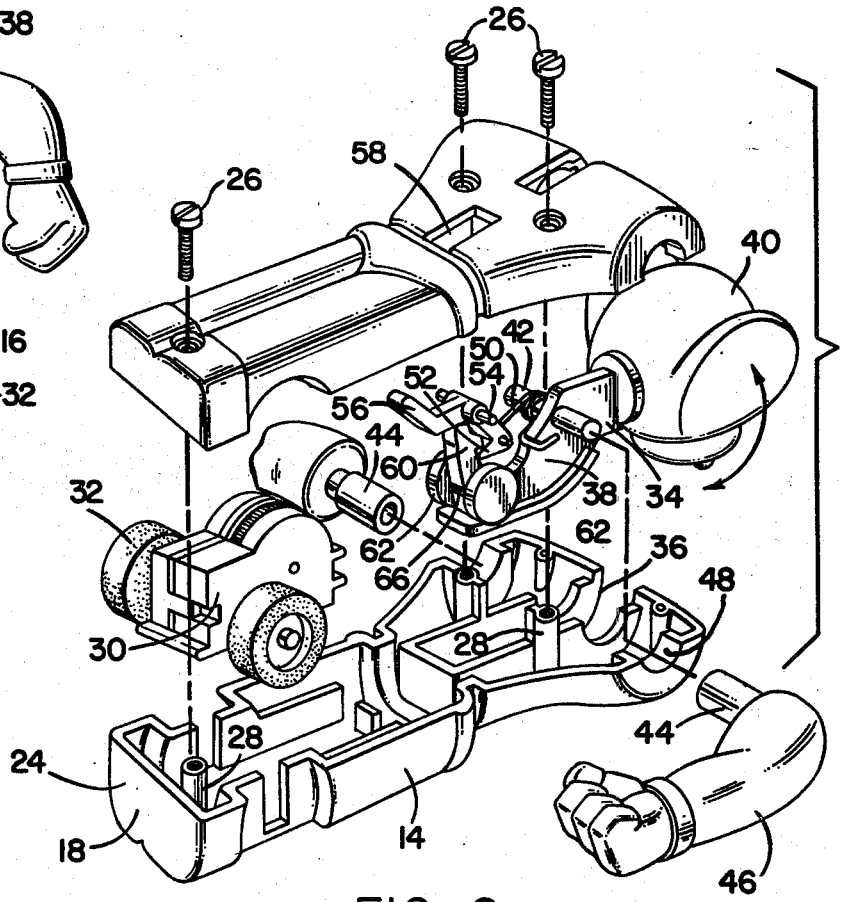
FIG. 2 is an exploded perspective view of the preferred embodiment of the toy of the present invention with parts of arm-simulating members of the toy being broken away on the view.

The exploded perspective view of FIG. 2 discloses the detailed construction of the toy 10 of the present invention. Thus, the toy 10 comprises an upper and lower shell, 12 and 14 respectively, of molded plastic. The upper and lower shells 12 and 14 assembled together comprise a lower or first portion 16 of the toy 10.

The lower or first portion 16 of the toy 10 is generally configured to simulate a lower body part, including the legs and torso, of the person, toy character, figure or animal which the entire toy 10 is designed to simulate. To this end, and with specific reference to the preferred embodiment shown on the drawing Figures, the first portion 16 includes a foot-simulating part 18, a leg and generally lower limb-simulating part 20, and a trunk-simulating part 22. The foot-simulating part 18 includes a substantially flat lowermost surface 24 which permits stationing the toy 10 on a support surface (not shown) in a substantially upright-standing posture.

The upper and lower shells 12 and 14 are fastened to one another by a plurality of bolts 26. The bolts 26 engage a plurality of matching internally-threaded mounting columns 28 provided in the lower shell 14.

In order to provide self-propelled locomotion to the toy 10, a windable spring-powered motor assembly 30 including a pair of wheels 32 is mounted in the first portion 16 between the upper and lower shells 14. It is not deemed necessary to disclose the details of construction of the motor assembly 30 in the present application for U.S. patent, because the motor assembly 30 can be built in accordance with standard practice in the art. It is sufficient to note for the purpose of explaining the present invention, that the spring-powered motor assembly 30 may be wound by turning the wheels 32 in one direction. Thereafter, release of the energy stored in the spring (not shown) rotates the wheels 32 in the other, opposite direction.

As is specifically shown on the drawing Figures, the wheel-bearing motor assembly 30 is mounted to the first portion 16 of the toy 10 in such a manner that the wheels 32 are disposed above the foot-simulating part 18. Therefore, in an upright-standing position of the toy 10, shown on FIG. 1, the wheels do not touch a support surface (not shown). The function of the wheels 32 is described below principally in conjunction with the description of FIG. 4.

Referring still principally to FIG. 2, mounting of a second portion 34 of the toy 10 to the first portion 16 is disclosed. The second portion 34 is generally configured to simulate the upper body part of the person, toy character, figure, or toy animal which the entire toy 10 simulates. More specifically, in the herein-described preferred embodiment, the second portion 34 simulates the head and neck of the toy figure.

The trunk- or torso-simulating part 22 of the first portion 16 incorporates an opening or slot 36 which is disposed substantially in line with the general longitudinal axis of the toy 10. The second portion 34 includes a plate-like member 38 which is mounted into the slot 36. A head-simulating part 40 is mounted to the plate-like member 38. In the herein-described preferred embodiment the head-simulating part 40 is itself pivotable relative to the plate-like member 38 on an axis which is substantially in line with the general longitudinal axis of the toy 10. This is indicated in the drawings by the arrow 42 of FIG. 2.

It is an important feature of the present invention that the second portion 34 is mounted to the first portion 16 to be capable of occupying two principal positions relative thereto. A first position is shown on FIGS. 1, 2 and 3, and a second position is shown on FIG. 4. As is perhaps best illustrated on the exploded perspective view of FIG. 2, the plate-like member 38 includes a pivot pin or rod 42 which protrudes from the plate-like member 38 in a direction substantially normal to the general longitudinal axis of the toy 10. The pivot pin 42 rotatably receives hollow tubular ends 44 of arm-simulating parts 46. The assembly of the arm-simulating parts 46 with the pivot pin 42 is received in an appropriately shaped saddle 48 provided in the molded plastic interior of the first portion 16.

Still referring principally to FIG. 2, a wire spring 50 is shown mounted to the pivot pin 42. The wire spring 50 is connected to a pawl 52 which is itself pivotably mounted on a suitable pin 54 into the interior of the first portion 16. The pawl 52 has a part 56 which protrudes from the interior of the first portion 16 through a notch 58 in the upper shell 12 and is accessible for manipulation by a player (not shown). The plate-like member 38 includes a substantially hook-shaped portion or hook 60 which is adapted to engage the pawl 52 in the manner shown on FIGS. 2 and 3. Finally, two parallel disposed metal discs 62 rigidly interconnected with an axle (not shown) are rotatably mounted in a small slot 66 disposed in the plate-like member 38.

Figure 3:
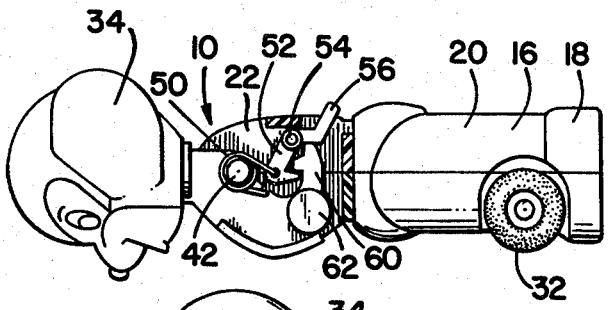
FIG. 3 is a side view, partly in cross-section, of the preferred embodiment of the toy of the present invention, the view showing the toy disposed in a first configuration.

The discs 62, which comprise wheels, are substantially hidden from view of a player (not shown) in the interior of the toy 10, and are not available for facilitating locomotion of the toy 10 when the second portion 34 is in the first position relative to the first portion 16. FIGS. 2 and 3 show that in the above-noted first position the pawl 52 engages the hook 60 to lock the second portion 34 into a configuration where the first portion 16 and the second portion 34 are substantially colinear with one another. In other words, in the first position, the toy 10 simulates an upright or standing person, toy character, figure or the like.

In the first position of the toy 10, the toy 10, like a person or animal it simulates, is not well suited for rolling on wheels or a support surface (not shown) because the wheels 62 are hidden and not available for contacting the support surface.

A player (not shown), however, may optionally press down on the protruding part of the pawl 52 to disengage the pawl 52 from the hook portion 60. When this occurs, the biasing force of the spring 50 pivots the second portion 34 on the pivot pin 42 about an axis substantially normal to the general longitudinal axis of the toy 10 and keeps the second portion 34 in its second position relative to the first portion 16. The overall configuration of the toy 10 in the second position is shown on FIG. 4. In this configuration the wheels 62 are visible, and available to cooperate with the wheels 32 of the spring-powered motor assembly 30 to propel the toy 10 on a support surface (not shown).

Figure 4:
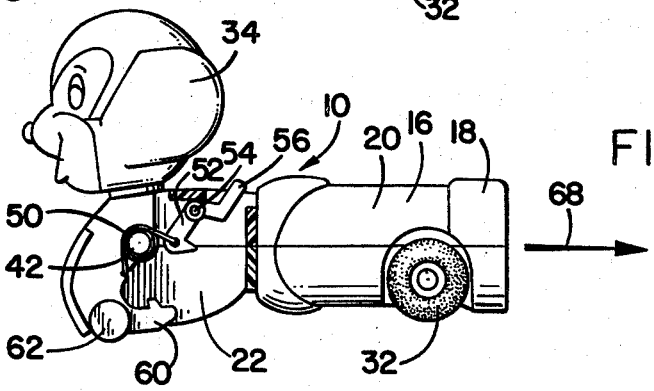
FIG. 4 is a side view, partly in cross-section, of the preferred embodiment of the toy of the present invention, the view showing the toy disposed in a second configuration.

As is shown on FIG. 4, in the second configuration the toy 10 simulates and, in effect, becomes a self-propellable toy vehicle. In this configuration the toy 10 also simulates a person, toy character, figure or the like in a prone position and nevertheless capable of self-propelled locomotion. In order to wind the spring motor assembly 30, a player (not shown) merely needs to move the toy 10 on the support surface (not shown) in the direction of the arrow 68 with the wheels 32 in contact with the support surface. Thereafter, the player (not shown) lets go of the toy 10 which rapidly drives forward on the support surface (not shown) until the energy stored in the spring motor assembly 30 is exhausted. The toy 10, of course, can be reconfigured into its first position at any time by pivoting the second portion 34 against the bias of the spring 50. Substantially at the end of travel of the second portion 34 on its pivoting arc relative to the first portion 16, the pawl 52 automatically engages the hook 60 and locks the toy 10 into the first position.

The advantages and play value of the toy 10 of the present invention, particularly for very young children, should be readily apparent from the foregoing description. A young child (not shown) playing with the toy 10 can readily convert the "upright-standing" toy figure into a simulated toy vehicle which rapidly travels on a support surface. Alternatively, the child (not shown) may view the toy figure as one capable of fast self-propelled movement in a substantially prone position.

Several modifications of the toy of the present invention may become readily apparent to those skilled in the art in light of the above disclosure. Therefore, the scope of the present invention should be interpreted solely from the following claims.

What is claimed is:

1. A toy figure convertible into a toy vehicle comprising:

a first portion configured to simulate a pair of legs and torso of a substantially upright-standing person, said portion having a general longitudinal axis disposed substantially vertically when the toy figure is disposed upright to substantially simulate an upright-standing person;

first wheel means mounted to the first portion for permitting locomotion of the toy figure;

a second portion substantially configured to simulate a neck and a head, said second portion being mounted to the first portion to pivot about an axis substantially normal to the general longitudinal axis of the toy figure;

positional means operatively associated with the first and second portions for maintaining the second portion in one of a first and a second position relative to the first portion at the option of a player, and second wheel means mounted to the second portion and substantially hidden from view in the first position of the second portion, the second wheel means being exposed to view and capable of coming into contact with a support surface when the second portion is disposed in its second position, whereby in the second position the first wheel means and second wheel means cooperate to provide locomotion for the toy figure on the support surface, wherein the positional means comprise a spring mounted to the second portion and a pawl operatively connected with the spring, pivotably mounted to the first portion, and having a protruding part accessible for manipulation by an operator, and wherein the second portion includes means for removably engaging the pawl, the pawl engaging means and the pawl normally keeping the second portion in the first position wherein the second wheel means are substantially hidden from view, the spring attempting to bias the second portion into the second position and moving the second portion into the second position when the pawl is manipulated by the operator to disengage the pawl engaging means.

2. The toy figure of claim 1 further comprising a spring motor incorporated into the first portion operatively associated with the first wheel means and windable by rotation of the first wheel means in a predetermined direction, whereby the toy figure may be rendered self-propelling over the support surface.

3. The toy figure of claim 2 wherein the first wheel means are mounted to the first portion of the toy figure for being out of contact with the support surface when the toy figure is disposed substantially upright.

4. The toy figure of claim 3 wherein the first wheel means comprise a pair of wheels.

5. The toy figure of claim 4 wherein the second wheel means comprise a pair of wheels.

6. The toy figure of claim 1 wherein the first wheel means comprise a pair of wheels rotatably mounted on an axle disposed substantially normal to the longitudinal axis of the toy figure.

7. The toy figure of claim 6 wherein the second wheel means comprise a unitary wheel assembly rotatably mounted on an axle disposed substantially normal to the longitudinal axis of the toy figure.

8. A toy configuration to substantially simulate a substantially upright-standing figure, and capable of being disposed in a substantially upright position on a support surface, the toy also capable of self-propelled locomotion on the support surface while substantially simulating a figure in a prone position, comprising:

a first portion configuration to simulate a lower portion including legs of the toy figure, the first portion incorporating a windable spring-powered motor operatively connected to a pair of wheels rotatable about an axis attached to the first portion;

a second portion configured to simulate the upper portion including the head of the toy figure, and adapted for occupying at least two positions relative to the first portion, the second portion including at least one rotatably mounted wheel substantially hidden from view in a first position of the second portion relative to the first portion, and exposed for contact with the support surface in a second position of the second portion relative to the first portion, and spring means operable by a player for placing the second portion into the second position at the option of the player, whereby the wheel previously hidden from view is exposed and the toy figure is capable of locomotion on the support surface.

9. The toy of claim 8 where the toy has a general longitudianl axis, and where the second portion in the second position is disposed substantially at a right angle to the general longitudinal axis.

10. The toy of claim 8 wherein the spring means comprise means for pivoting the second portion of the toy figure approximately 90 degrees about an axis which is substantially normal to a general longitudinal axis of the toy figure.

11. The toy of claim 8 wherein the spring means include a spring mounted to the second portion, a pawl operatively connected with the spring and pivotably mounted to the first portion and having a part accessible for manipulation by an operator, and wherein the second portion has means for releasably engaging the pawl and for keeping the second portion in the first position.

12. The toy of claim 11 wherein the first portion includes a cavity wherein the spring means are mounted, said cavity also containing the wheel of the second portion in the first position of the second portion.

13. In a toy configuration to simulate a person, toy animal figure and the like, having a general longitudinal axis, a first portion generally configured to simulate a lower part including the legs of a body of the toy figure, and second portion generally configured to simulate an upper part including the head of the body of the toy figure, and first wheel means incorporated in the first portion for permitting locomotion of the toy figure on a support surface, the improvement comprising:

second wheel means mounted to the second portion, and positional means operatively associated with the first portion and the second portion for disposing and maintaining the second portion in one of two positions relative to the first portion, in a first of said two positions the second wheel means being substantially hidden within an interior of the toy, and in a second of said two positions the second wheel means being exposed and operable in cooperation with the first wheel means to permit locomotion of the toy on the support surface wherein the positional means comprise biasing spring means operatively associated with the first and second portions for biasing the second portion into its second position, and player releasable locking means operatively associated with the first and second portions to lock the second portion into its first position.

14. The improvement of claim 13 wherein the first portion includes a windable spring motor operatively connected with the first wheel means.

15. The improvement of claim 14 wherein in its second position the second portion is disposed substantially at a right angle to the general longitudinal axis of the toy figure.

16. The improvement of claim 15 wherein in the first position of the second portion the toy is configured to simulate a substantially upright-standing person, toy animal figure and the like, and in the second position of the second portion the toy is configured to substantially simulate a prone person, toy animal figure and the like.

17. The improvement of claim 16 wherein the first and second wheel means comprise wheels mounted for rotation about axes which are substantially normal to the general longitudinal axis of the toy figure.

18. The improvement of claim 13 wherein the locking means include a pawl pivotably mounted to the first portion and having a protruding part accessible for manipulation by the player, and a hook-shaped part incorporated in the second portion for releasably engaging the pawl.

* * * * *